US008141317B1

(12) United States Patent
Qiao et al.

(10) Patent No.: US 8,141,317 B1
(45) Date of Patent: Mar. 27, 2012

(54) BISTABLE BOND LATTICE STRUCTURES FOR BLAST RESISTANT ARMOR APPLIQUES

(75) Inventors: Pizhong Qiao, Pullman, WA (US); Mijia Yang, Pullman, WA (US)

(73) Assignee: The University of Akron, Akron, OH (US)

( * ) Notice: Subject to any disclaimer, the term of this patent is extended or adjusted under 35 U.S.C. 154(b) by 818 days.

(21) Appl. No.: 11/487,631

(22) Filed: Jul. 17, 2006

Related U.S. Application Data

(60) Provisional application No. 60/699,471, filed on Jul. 15, 2005.

(51) Int. Cl.
*E04B 1/18* (2006.01)

(52) U.S. Cl. ..... 52/633

(58) Field of Classification Search ..... 52/652.1, 52/573.1, 660, 661, 662, 664, 676, 5, 831, 52/633, 649.1, 719; 109/49.5, 58; 180/232; 43/4, 7, 8; D12/163; 296/35.2; 256/1; 89/36
See application file for complete search history.

(56) References Cited

U.S. PATENT DOCUMENTS

| | | | | |
|---|---|---|---|---|
| 3,951,730 | A * | 4/1976 | Wennberg et al. | 428/116 |
| 5,196,252 | A * | 3/1993 | Harpell | 428/102 |
| 5,462,144 | A * | 10/1995 | Guardiola et al. | 188/377 |
| 6,031,703 | A * | 2/2000 | Serpinet et al. | 361/103 |
| 6,076,324 | A * | 6/2000 | Daily et al. | 52/648.1 |
| 7,478,579 | B2 * | 1/2009 | Carberry et al. | 89/36.02 |
| 7,490,539 | B2 * | 2/2009 | Ma | 89/36.02 |
| 7,563,497 | B2 * | 7/2009 | Ma | 428/86 |
| 2005/0126106 | A1 * | 6/2005 | Murphy et al. | 52/652.1 |

OTHER PUBLICATIONS

Slepyan et al., "Transition Waves in Controllable Cellular Structures with High Structural Resistance", The XXI International Congress of Theoretical and Applied Mechanics (ICTAM) Aug. 2004, Warsaw, Poland.*

Whitman et al., "Improvement of Energy Absorption Through the Use of Bistable Structures", Society for the Advancement of Matieral and Process Engineering (SAMPE) Conference 2005 (May 1-4, 2005), Long Beach, CA.*

Ambur, D, R. et al, Numerical simulations . . . , International Journal of Impact Engineering, 2001, 25, 683-702.

Shim, V. P., et al., Modelling deformation and damage . . . , International Journal of Impact, 1995, vol. 16, No. 4, 585-608.

Lee, Y.S., et al., The ballistic impact characteristics of Kevlar . . . , Journal of Materials Science, 2003, 38, 2825-2833.

Lee, M., et al., Analysis of ceramic/metal armour system, International Journal of Impact Engineering, 2001, 25, 819-829.

Chen, M. W., et al., Shock-induced localized amorphization in Boron Carbide, Science, 2003, 299(7),1563-1566.

Guruprasad, S. et al., Layered sacrificial claddings under blast loading, Part I—Analytical studies, International Journal of Impact Engineering, 2000, 24, 957-973.

(Continued)

*Primary Examiner* — David Sample
*Assistant Examiner* — Nicole Gugliotta
(74) *Attorney, Agent, or Firm* — Renner Kenner Greive Bobak Taylor & Weber

(57) ABSTRACT

The present invention relates generally to improved lattice structures that can be used in, for example, blast resistant armor appliqués. In another embodiment, the present invention relates to methods for designing improved lattice structures where the lattice structures are bistable bond lattice structures. In still another embodiment, the present invention relates to lattice structures that employ asymmetric waiting links and unequal lengths of main links.

9 Claims, 14 Drawing Sheets

OTHER PUBLICATIONS

Evans, A. G., et al., The Topological design of multifunctional cellular metals, Progress in Materials Science, 2001, 46, 309-327.
Xue, Z., et al., A comparative study of impulse-resistant metal sandwich plates, International Journal of Impact Engineering, 2004, 30, 1283-1305.
Fleck, N. A., et al., The resistance of clamped sandwich beams to shock loading, Journal of Applied Mechanics, 2004, 71, 386-401.
Taylor, W. T., et al., Modeling Ballistic Impact into Flexible Materials, AIAA Journal, 1990, vol. 28, No. 12, 2098-2103.
Cherkaev, A. V., et al., Waiting element structures and stability under extension, International Journal of Damage Mechanics, 1995, 4:58-82.
Cherkaev, A.V. , et al., Dynamics of damage . . . , in: Asymptotics, Singularities and Homogenisation in Problems of Mechanics, Editor: Movchan, B.A., Kluwer, 2004, 273-284.
Cherkaev, A., et al., Transition waves in bistable structures. I . . . , Journal of Mechanics and Physics of Solids, 2005, 53, 383-405.
Slepyan, L., et al., Transition waves in bistable structures II . . . , Journal of Mechanics and Physics of Solids, 2005, 53, 407-436.
Balk, A.M., et al., Dynamics of chains with non-monotone . . . , Journal of the Mechanics and Physics of Solids, 2001, 49, 131-148.
Slepyan, L.I., et al., Localized transition waves in bi-stable-bond lattices, Journal of the Mechanics and Physics of Solids, 2004, 52, 1447-1479.
Dancila, D.S., et al., Energy-Dissipating Composite Members . . . , AIAA Journal, 2002, vol. 40, No. 4, 2096-2104.
Ha, K., et al., Energy-dissipating snap-resistant tether, AIAA 41st Areospace Sciences Meeting and Exhibit, Jan. 6-9, 2003, Reno, Nevada.
Pouget, J., Stability of nonlinear structures in a lattice model for phase transformations in alloys, Physical Review B, 1992, vol. 46, No. 17, 10554-10562.
Pouget, J., Lattice dynamics and stability of modulated-strain structures for elastic phase transitions in alloys, Physical Review B, 1993, vol. 48, No. 2, 864-875.
Ryvkin, M., et al., Nucleation of cracks . . . , XXI ICTAM, Aug. 2004, Warsaw, Poland.
Tkachev, P. V., et al., Computer simulation of 2D dynamic . . . , Proceedings of XXXI advanced problems in mechanics, Aug. 2004, St-Petersburg, Russia.
Whitman, Z., et al., Improvement in energy absorption . . . , Proceedings of SAMPE 2005 International Symposium and Exhibition, May 2005, Long Beach, CA.

* cited by examiner

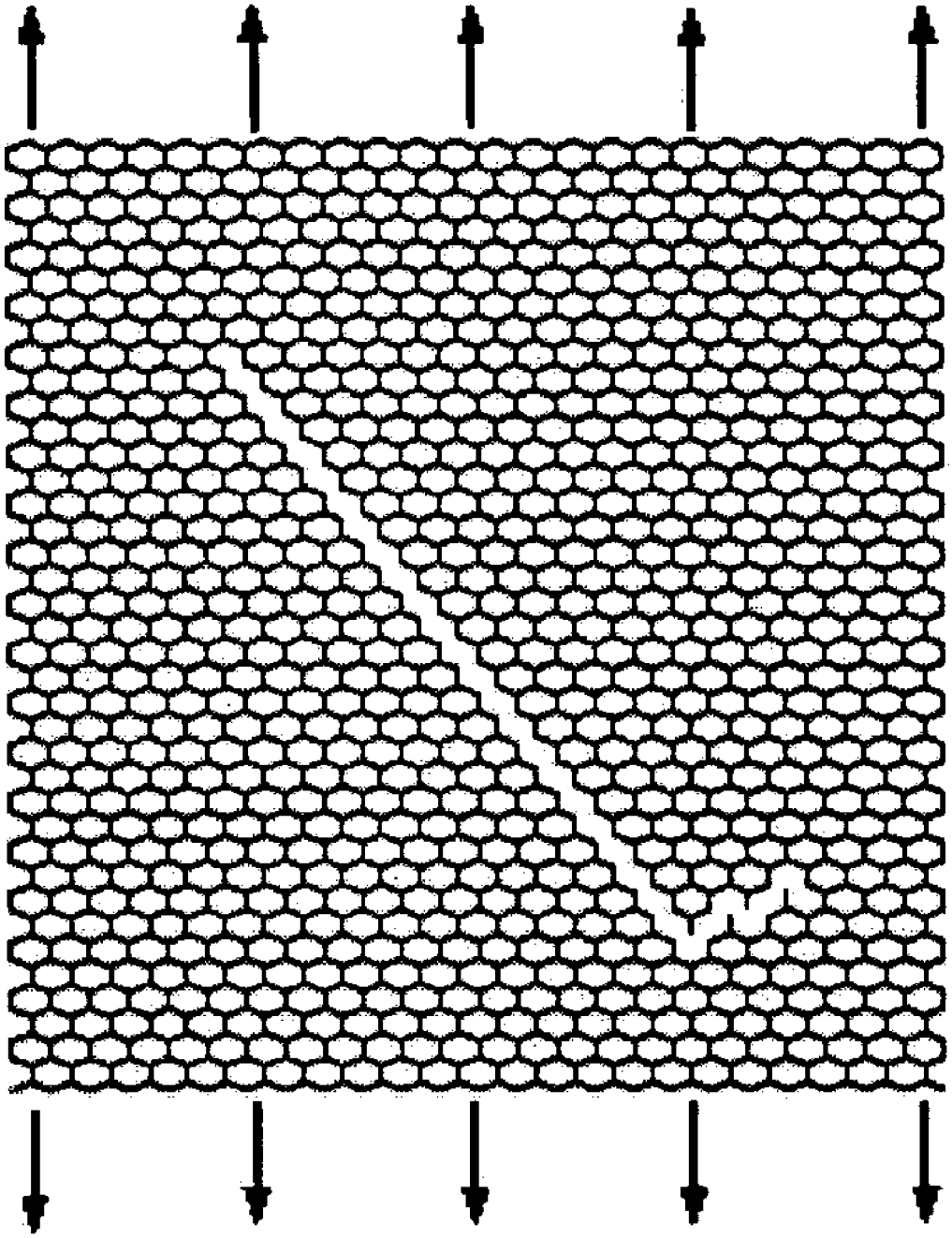
FIG.1(a) – Honeycomb Lattice

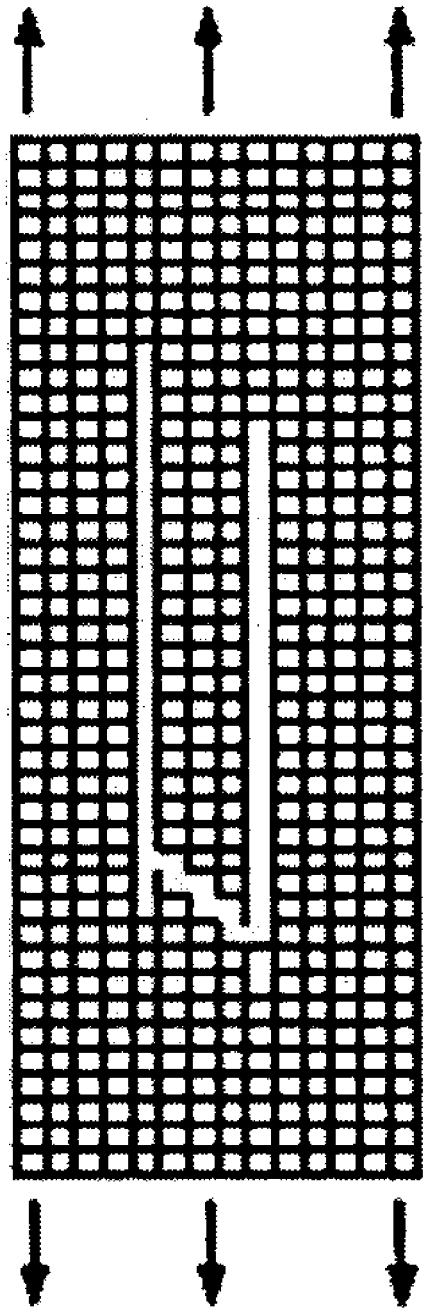
FIG. 1(b) – Rectangle Lattice

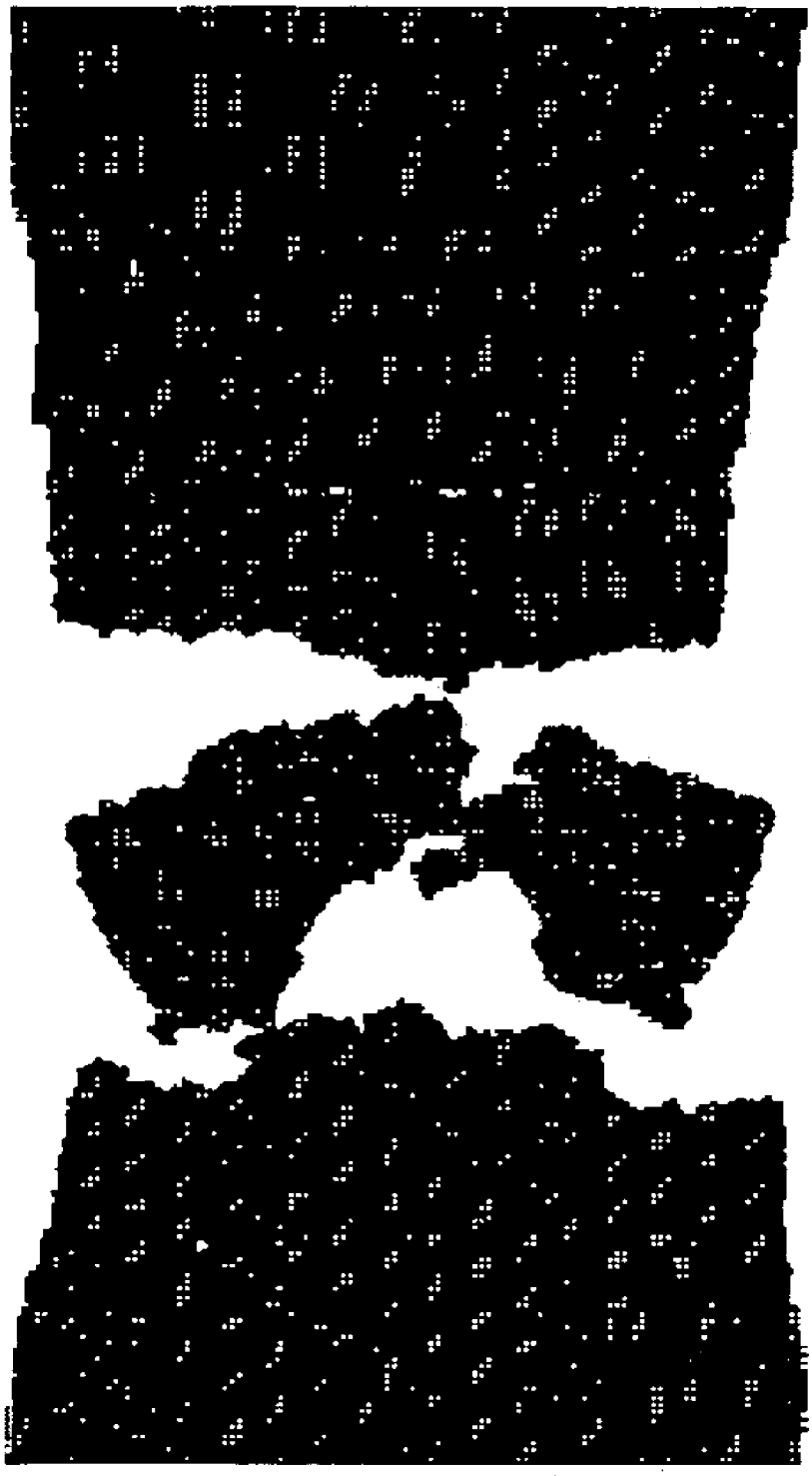
FIG. 2(a) – Horizontal

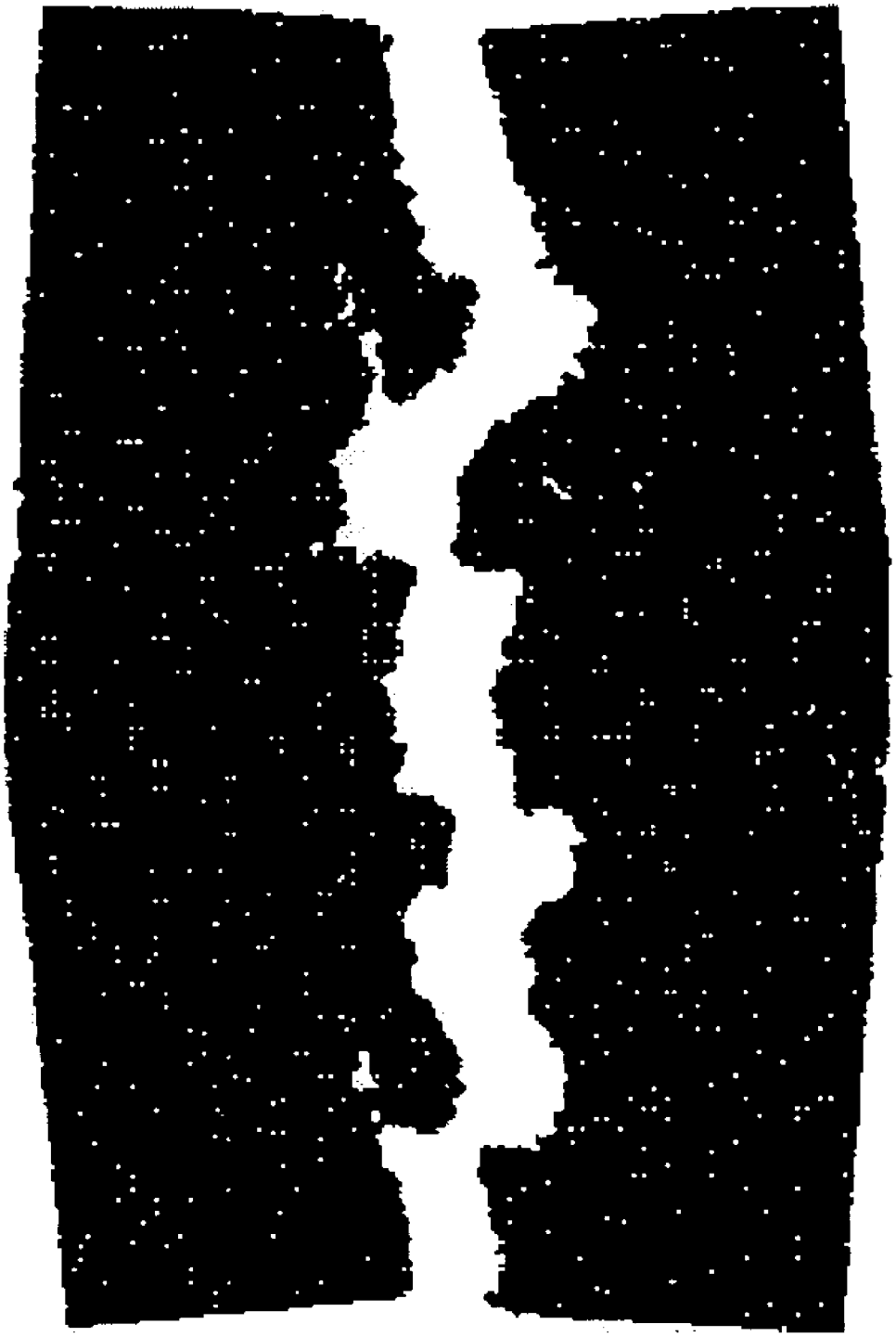
FIG. 2(b) – Vertical

····· waiting link
—— main link

····· waiting link
—— main link

BISTABLE BOND LATTICE STRUCTURES FOR BLAST RESISTANT ARMOR APPLIQUES

RELATED APPLICATION DATA

This application claims priority from U.S. Provisional Patent Application No. 60/699,471, filed Jul. 15, 2005 and entitled "Bistable Bond Lattice Structures for Blast Resistant Armor Appliqués," which is hereby incorporated by reference in its entirety.

FIELD OF THE INVENTION

The present invention relates generally to improved lattice structures that can be used in, for example, blast resistant armor appliqués. In another embodiment, the present invention relates to methods for designing improved lattice structures where the lattice structures are bistable bond lattice structures. In still another embodiment, the present invention relates to lattice structures that employ asymmetric waiting links and unequal lengths of main links.

BACKGROUND OF THE INVENTION

Recent United States military missions demonstrated the need for effective and light-weight armor systems that can rapidly respond to a broad range of threats in limited regional conflicts. Ballistic experts in recent years have puzzled over a troubling loss of impact resistance in an extremely hard and lightweight ceramic material called boron carbide, sometimes used in protective armor. The material does an excellent job of blocking low-energy projectiles such as handgun bullets, but shatters too easily when struck by more powerful ammunition.

By observing the atomic structure of boron carbide fragments retrieved from a military ballistic test facility, researchers discovered that the higher-energy impacts cause tiny bands of boron carbide to change into a more fragile glassy form. This high-impact pressure-related amorphyization, or transformation to a glassy material, was previously seen in minerals and semiconductors, and it was also found in a ceramic as hard as boron carbide. The extremely high velocities and pressures associated with impact of a high-powered projectile appear to cause microscopic portions of the crystalline lattice structure of the material to collapse. Based on the analogy of crystalline material, most of modern lightweight armor appliqués are designed in periodic lattice or cellular truss configurations, which provide relatively effective blast energy dissipation strategies.

However, it was also expected that the high intensive wave could cause band instability or collapse in a lattice structure. Numerical simulations proved that the banded failures were formed in the two lattice structures initiated by one broken link (see FIGS. 1(*a*) and 1(*b*)). Experiments also indicated that the different orientations of lattice structures could cause different formats of failures in a lattice structure (see FIGS. 2(*a*) and 2(*b*)).

Including the waiting links in the structure could improve the situation of banded failure; however, the narrow banded shock waves by the broken links in a conventional triangle or square-cell lattice could still cause high banded deformations as well as banded failures. A series of conventional triangle lattice structures were simulated, and the strain concentration was found on the two ends (see FIGS. 3 and 4). Tiny bands of the whole structure experience total broken, leading to the failure of the whole lattice. Even though the lattice structures with "waiting element" showed the potential as an effective blast assistant armor appliqué, there is still a need to improve the present designs, due to the likelihood of banded failure expected in the conventional lattice structures.

SUMMARY OF THE INVENTION

The present invention relates generally to improved lattice structures that can be used in, for example, blast resistant armor appliqués. In another embodiment, the present invention relates to methods for designing improved lattice structures where the lattice structures are bistable bond lattice structures. In still another embodiment, the present invention relates to lattice structures that employ asymmetric waiting links and unequal lengths of main links.

In one embodiment, the present invention relates to a lattice structure comprising: a triangle cell lattice structure with one or more asymmetrical waiting elements, wherein the triangle lattice structure also has unequal main links.

In another embodiment, the present invention relates to a lattice structure comprising: a square cell lattice structure with one or more asymmetrical waiting elements, wherein the triangle lattice structure also has unequal main links.

In still another embodiment, the present invention relates to a lattice structure comprising: a lattice having a structure as shown in FIG. 5(*a*).

In yet another embodiment, the present invention relates to a lattice structure comprising: a lattice having a structure as shown in FIG. 5(*b*).

BRIEF DESCRIPTION OF THE DRAWINGS

FIGS. 1(*a*) and 1(*b*) are illustrations of banded collapses and/or failures in a honeycomb lattice (FIG. 1(*a*)) and a rectangular lattice (FIG. 1(*b*)) as caused by a single broken link;

FIGS. 2(*a*) and 2(*b*) are illustrations of a horizontal fracture (FIG. 2(*a*)) and a vertical fracture (FIG. 2(*b*)) in respectively oriented horizontal and vertical crystal lattices;

FIG. 5(*b*) illustrates another possible lattice structure within the scope of the present invention the lattice structure being a square cell lattice with an asymmetric waiting element;

FIG. 6(*b*) is an illustration of a modified square cell lattice having unequal main links and asymmetric waiting links formed in accordance with one embodiment of the present invention;

FIG. 10(*b*) is a graph that illustrates the displacement time history of the upper two nodes shown in FIG. 10(*a*) both with and without waiting links;

FIG. 11(*b*) is a graph that illustrates the displacement time history of the three of the nodes shown in FIG. 11(*a*) both with and without waiting links;

DETAILED DESCRIPTION OF THE INVENTION

Figure 3:
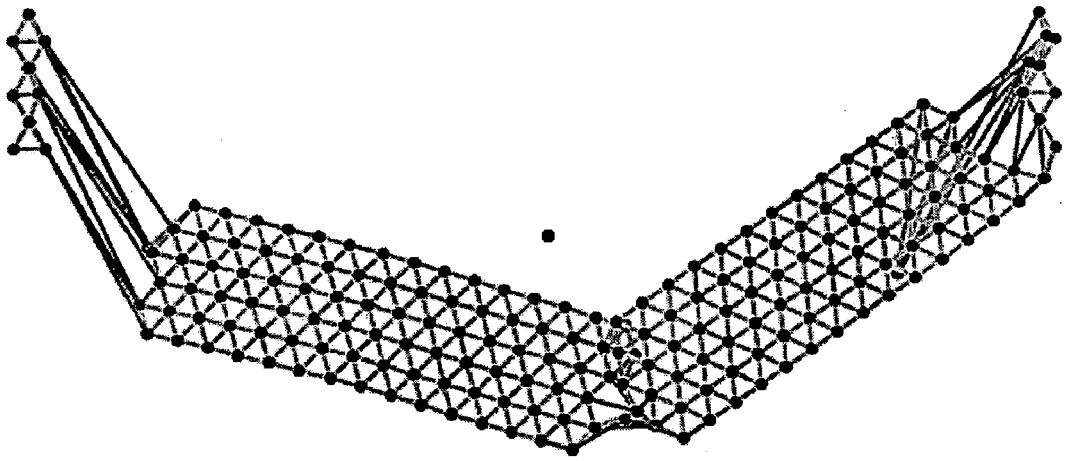
FIG. 3 illustrates the banded deformation formed on the two ends of a bridge-like lattice structure with waiting links of $\alpha=0.5$ ($\alpha$ is the percentage of material used in a waiting link in comparison to the main link in the lattice structure)
Figure 4:
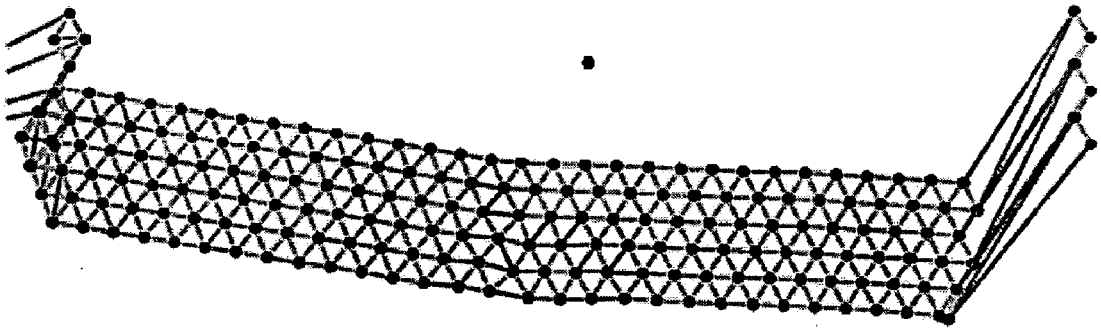
FIG. 4 illustrates the banded deformation formed on the two ends of a bridge-like lattice structure with waiting links of $\alpha=1.0$ ($\alpha$ is the percentage of material used in a waiting link in comparison to the main link in the lattice structure)

The present invention relates generally to improved lattice structures that can be used in, for example, blast resistant armor appliqués. In another embodiment, the present invention relates to methods for designing improved lattice structures where the lattice structures are bistable bond lattice structures. In still another embodiment, the present invention relates to lattice structures that employ asymmetric waiting links and unequal lengths of main links.

In one embodiment of the present invention, novel lattice designs are employed to: (1) meet the demand of effective and high performance armor appliqués; (2) to minimize the localized and/or banded deformation or failure in conventional triangle and square-cell lattices; and (3) to allow for the production of armor that is designed to distribute damage as evenly as possible under blast impact, thereby avoiding local band failure and maximizing energy dissipation. In one embodiment, the lattice structures of the present invention employ the concepts of asymmetric waiting links and unequal lengths of main links (e.g., non periodic inner structure) to randomly control the high-frequency blast excited waves and to distribute the partially damaged element over large areas as even a manner as possible. In another embodiment, the present invention permits the designing and production of lattice structures that do not suffer from the banded deformation problem common to conventional lattice structures.

In still another embodiment, lattice structures according to the present invention that contain asymmetric waiting links and unequal lengths of main links have the capability of diffracting any partial damaged waves generated by broken waiting links as efficiently as possible, while at the same time spreading any localized damage across, throughout, and/or to the whole lattice structure. This in turn enhances the energy absorption capability of the lattice structures of the present invention, thereby leading to an improved ballistic resistance as is required for armor design (especially for blast loading).

Due to the present invention, it is now possible to design and produce a new class of bistable lattice structures with asymmetric waiting links and unequal lengths of main links thereby making possible improved blast assistance for armor appliqués.

As noted above, the present invention also relates to methods for designing improved lattice structures where the lattice structures are bistable bond lattice structures and are suitable for use in armor appliqués.

In one embodiment, a method according to the present invention for developing/designing lattice structures for armor appliqués primarily involves the steps of: (1) theoretical and numerical modeling; (2) evaluation of critical parameters (e.g., geometric, loading, and material); and (3) potential implementation. As mentioned above, the present invention is directed to, in one embodiment, lattice structures with asymmetric waiting links and unequal main links. In a more specific embodiment, the present invention relates to a modified 2D-triangle lattice structure (see FIG. 5(*a*)) and a square cell lattice structure (see FIG. 5(*b*)), where both structures have asymmetric waiting links and unequal main links. The lattice structures of the present invention are designed in such a manner so as to make possible the even or nearly even distribution of localized or partial damage over a large area or areas of the lattice structure.

Initially, a theoretical framework on the failure or partial damage waves propagated through the two proposed novel lattice structures is developed and utilized in the method of the present invention. In particular, the effect of the novel designs of the present invention will be compared to conventional triangle-cell and square-cell lattices in terms of design effectiveness. Additionally, the conditions in which the local banded failure is formed will be addressed, as will the failure shock wave or the partial damage waves that are parallel to the preferred banded failure orientation.

Figure 6A:
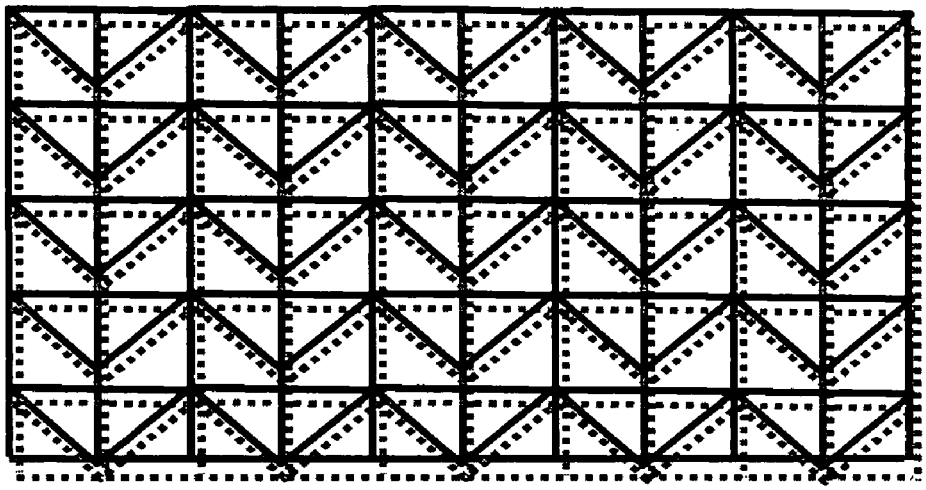
FIG. 6(*a*) is an illustration of a modified triangle cell lattice having unequal main links and asymmetric waiting links formed in accordance with one embodiment of the present invention.
Figure 6B:
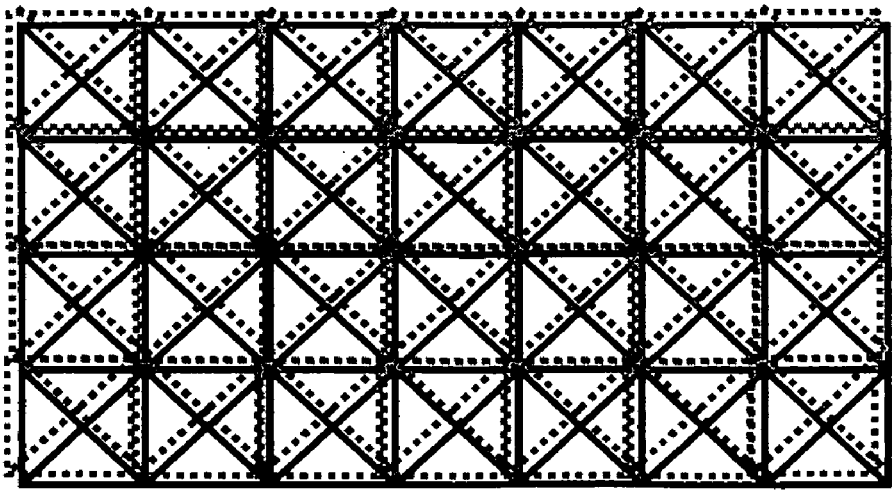

Although a conventional triangle lattice structure is still the most stable and efficient structure for energy-dissipation, both a conventional triangle lattice, as well as a conventional square lattice, suffer from the following drawbacks or disadvantages: (a) pure triangle or square cell lattices (i.e., with equal length of main links) are highly prone to banded failure or deformations; and (b) a failure wave can initiate and propagate in a parallel manner over the localized shear band, thereby reducing the effectiveness of an anti-blast design. To solve the above shortcomings, one effective design within the scope of the present invention is to use a modified triangle cell lattice with unequal main links and asymmetric waiting links (see FIG. 6*a*) to diffract, as much as possible, a shock wave formed by broken links to surrounding nodes. Another effective design within the scope of the present invention is a modified square cell lattice with unequal main links and asymmetric waiting links (see FIG. 6*b*). The modified square design also allows for the diffraction of a shock wave formed by broken links to surrounding nodes. The solid lines in FIGS. 6(*a*) and 6(*b*) indicate the main links; while the dashed lines denote the waiting links. The modified designs of the waiting elements is designed to distribute a failure more uniformly throughout the whole structure by diffracting the blast-excited shock wave from the broken links and avoiding the banded deformation or failure, thus leading to better ballistic energy dissipation. The unequal main links imply that the lengths or stiffness of the links within the main element (a unit cell) are not equal; while an asymmetric waiting link means that each link has its own waiting link and properties depending on the length of main link, which is different from conventional triangle or square cell lattices.

As would be apparent to those of ordinary skill in the art, the ballistic impact of a projectile or a blast loading on multilayered lattice structures involves a very complicated process. Approximate analytical solutions as well as an in-depth sensitivity study of parameters using advanced numerical methods are needed to fully understand the underlying mechanism as well as optimal design of the multilayered lattice armor system. Some numerical solutions are available in the literature, in which two types of lattice structures were studied, namely, triangle-cell lattice (see, e.g., Cherkaev, A. V., et al.; *Dynamics of Damage in Two-Dimensional Structures with Waiting Links*; Asymptotics, Singularities and Homogenisation in Problems of Mechanics; Editor:

Movchan, B. A.; pp. 273 to 284; 2004) and square-cell lattice (see, e.g., Slepyan, L. I., et al.; *Localized Transition Waves in Bistable Bond Lattices*; Journal of the Mechanics and Physics of Solids; Vol. 52; pp. 1447 to 1479; 2004). With regard to the lattice structures of the present invention (i.e., lattice structures with unequal main links and asymmetric waiting links) no existing solution is available yet. Accordingly, the discussion below introduces the framework necessary for the analysis of the lattice structures of the present invention.

Figure 7:
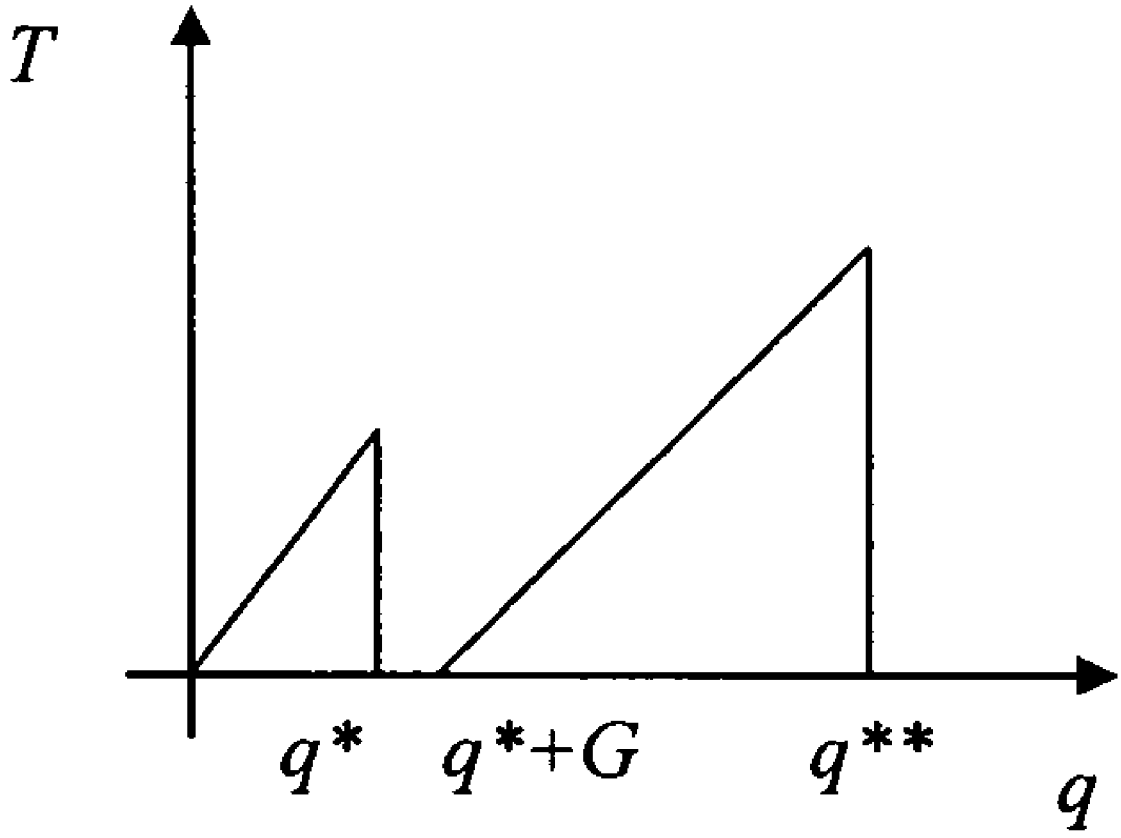
FIG. 7 is a plot of a two-branch piece-wise linear function demonstrating bistable force-elongation diagrams.

Bistable Links:

Consider a periodic chain of equal masses, M, connected by equal bistable links of length a. The tensile force T(q) acting in each link is a non-monotonic function of the elongation q containing two stable (increasing) branches separated by an unstable region. Under a monotonic elongation, the tensile force T(q) is characterized by:

$$\frac{dT}{dq} = \begin{cases} > 0 & \text{when } q < q^* \\ \leq 0 & \text{when } q^* < q < q^* + G \\ > 0 & \text{when } q^* + G < q < q^{**} \end{cases} \quad (1)$$

and T=0 when q>q. Here G is the gap between the stable branches (see FIG. 7). The dependence of T(q) vs. q is shown in FIG. 7**. Note that this non-monotonic force-elongation dependence corresponds to non-convex strain energy of the link and q*, G and q** will be different for different links.

In the initial state, the elongation q is smaller than the critical value q* (i.e., q<q*), which marks the first stable branch of the graph of FIG. 7. When the link is monotonically elongated and the elongation reaches the critical value q*, the link transitions to the second stable branch passing through the instable region. Due to the instability involved from the first stable branch to the second stable branch, the transition is characterized by an abrupt jerk-type motion which creates a significant kinetic energy of the masses connected by the link.

To account for irreversible damage, one can introduce a time-dependent damage indictor D(t,q), which depends on the elongation history. The damage indicator is equal to zero in the beginning of the elongation and until the elongation reaches the critical value q* the first time, where it then becomes equal to one. The dependence of damage indicator to the elongation (q) is stated as:

$$D(t, q) = \begin{cases} 0 & \text{when } \max_{\tau \in [0,t)} (q(\tau)) < q^* \\ 1 & \text{otherwise} \end{cases} \quad (2)$$

The state of the link under any time dependent loading is described as $$T(q,D) = (1 - D_1(t))T_1(q) + (1 - D_2(t))T_2(q) \quad (3)$$

where $T_1(q)$ is the dependence for the first stable region, and $T_2(q)$ is that for the second stable branch. The first damage parameter NO is defined in Equation (2), while the second damage parameter $D_2(t)$ is defined as the same as in Equation (2) but with q* substituted by q**.

A bistable bond can be realized as a "waiting link" or "waiting element" structure. An element of the structure (e.g., a link or the bond), comprises two generally parallel links, one straight and the other slightly curved, joined by their ends. The straight link resists elongation as an elastic-brittle material. It is assumed that the longer link (e.g., the slightly curved one) does not resist any elongation until it is straightened (the bending stiffness is neglected). Then, the longer link starts to resist the elongation in a similar fashion to the straight link. The straight link is characterized as the basic link; while the curved link is called the waiting link because it waits for the right time to start the effect of resistance to elongation.

A bistable-link chain is characterized by multiple equilibriums. Two locally stable states exist in each link. If the chain consists of N links, it has $2^N$ states of equilibrium. Consider a chain with the fixed left mass, and let the right mass start to move slowly to the right. Until the tensile force in the chain reaches the critical value T(q*) in which only the basic links provide the resistance to the tension. At some point, one of the basic links breaks and the corresponding waiting link is then activated. The tensile force in each link elongates, while other links contract to keep the total elongation reached by the chain. The tensile force in each link of the chain and hence the strain energy are decreased due to the breakage of the basic link in the chain; however, the work of the external force still stays the same. The difference between the external work and the strain energy in the links is the dissipated energy, which dissipates over the structure as a dissipated wave. The dissipated wave will cause other links to react. This process will continue until the other steady state is reached. During this process, the multiple periodic breakages and multiple reloadings in the chain before its final rupture reflect the delocalization of large strains, which is a preferred failure mode desired in the armor design.

Next, dynamic formulation is used to determine the process of the transition from the low-elongation basic state to the high-elongation state. In dynamics, this process is characterized by a system of waves, which includes the long step waves and the oscillating dissipative waves. Recall that, due to instabilities caused by non-monotonic character of the force-elongation relation, the dynamic effects are considerable even in the case of an arbitrary low, quasi-static loading rate, and the above quasi-static considerations allow one to estimate the total dissipated energy, but not the wave propagation and pattern.

The dynamics of the chain is described by a system of different differential equations with respect to the displacement, $u_m$, of the masses and elongation, $q_m = u_m - u_{m-1}$. It has the form of:

$$M\ddot{u}_m + \gamma\dot{u}_m = \sum_{i=1}^{N(i)} T(q_i, D_i^b, D_i^w) \quad (4)$$

where m is the number of the mass; M is the mass; γ is the coefficient of viscosity introduced to stabilize numerical simulations; and $D_m^b$ and $D_m^w$ are the damage parameters of the basic and waiting links in the m-th link; T is the force function of each link; and N(i) is the set of knots neighboring the knot i.

In general, a sub-critical step wave is found propagating ahead of the transition wave. In a finite chain, when the step wave reaches the opposite (fixed) end of the chain, it reflects and its magnitude increases. This increase can initiate a contra-directional transition wave moving towards the initial impact point. The transition wave can also be initiated when two reflected elastic waves meet.

Figure 8:
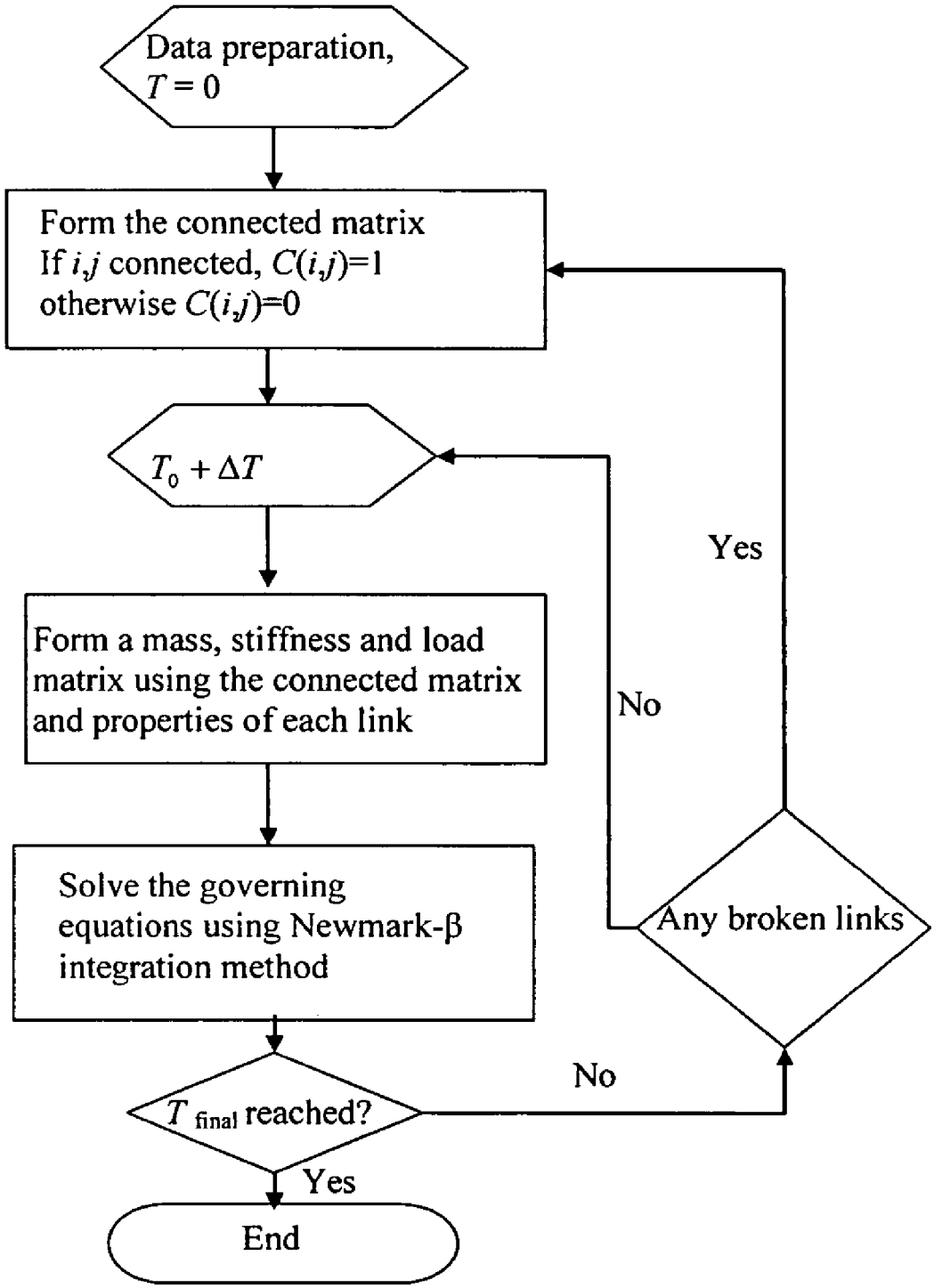
FIG. 8 is a flow chart illustrating the process used for numerical integration of the impact responses of lattice structures formed in accordance with the present invention.

Semi-analytical model realization using numerical integration: The above governing equation (Equation (4)) can be solved using a numerical integration technique. The semi-analytical results can provide some hints on how to find the wave patterns in a lattice structure. Also the semi-analytical method could be used to conduct design optimization over the lattice structure and obtain the corresponding optimal parameters, for example, the gap (G) between the stable branches in the bistable link (see FIG. 7). A flow chart illustrating numerical integration and computational procedures according to one embodiment of the present invention is shown in FIG. 8.

Numerical simulations of the lattice structure over impact loading: Numerical simulation of lattice structures with the waiting links (both conventional lattice structures and those in accordance with the present invention) is conducted using the commercial finite element software LS-DYNA. In the LS-DYNA modeling, each link is simulated as Hughes-Liu shell element as a linear brittle elastic material of MAT_BRITTLE_DAMAGE with a brittle failure criteria (tensile stress) using Material type 96. The projectiles are modeled as a bi-linear elastic-plastic material using Material type 3 (MAT_PLASTIC_KINEMATIC), which contains isotropic and kinematic hardening. The strain rate effect accounts for both the basic and waiting links, and the projectiles, by using the strain rate dependent factor obtained from experimental studies. The quasi-static results, as well as dynamic impact, by different projectiles are simulated. The blast responses of the lattice structures of the present invention are also simulated in LS-DYNA using CONWEP model. The equivalent explosive mass and stand-off distance can be set using Load_Blast card.

Figure 9:
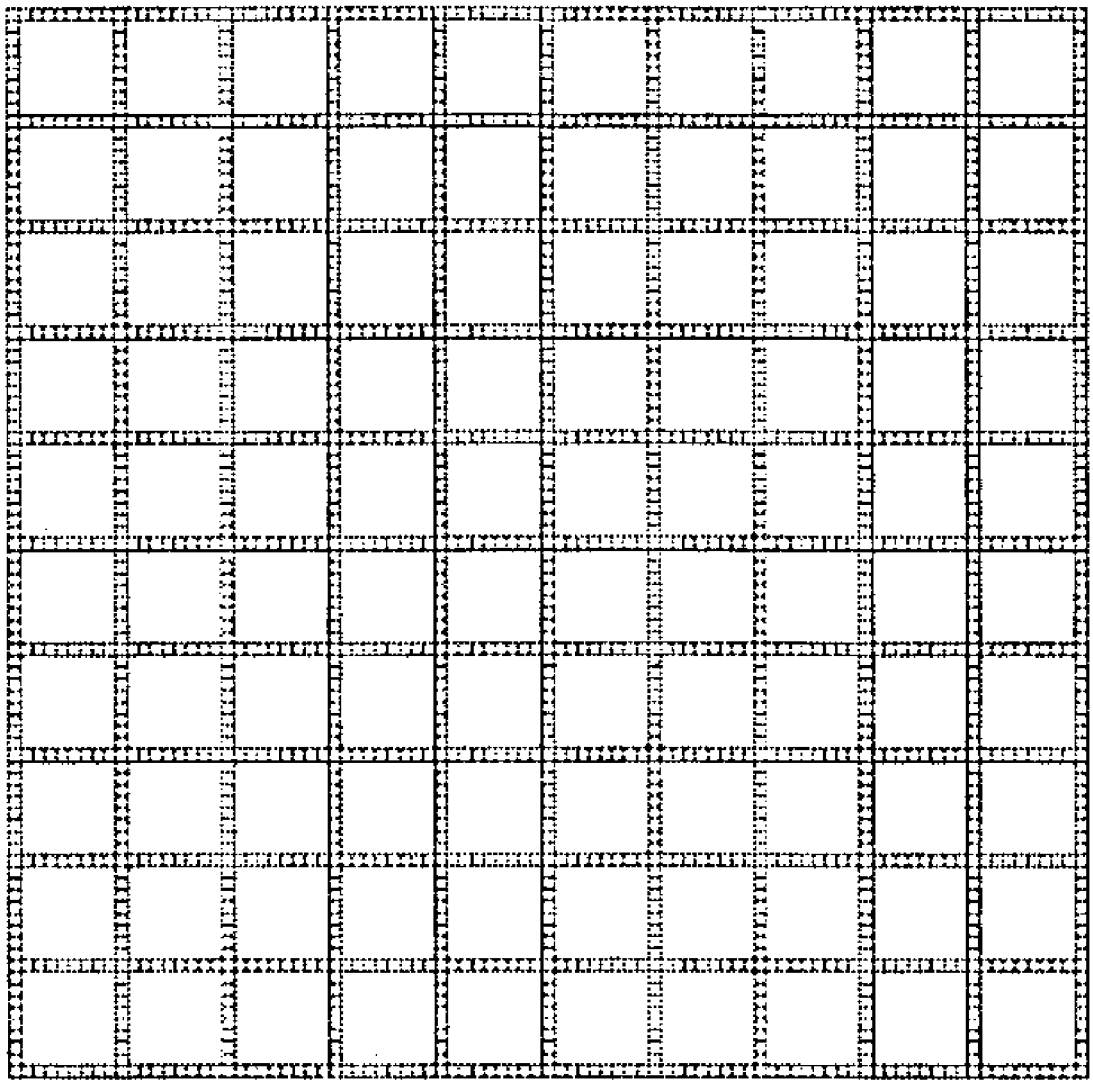
FIG. 9 is an illustration of a square-cell lattice.

A conventional square-cell lattice (see FIG. 9) without waiting links and with waiting links is simulated. The simulation is performed using LS-DYNA. The element size was 0.1×0.1×0.1 mm, and the type of element is an 8-node solid element. The material is chosen as type 13 (MAT_ISOTROPIC_ELASTIC_FAILURE) with the shear modulus of 32.0 GPa and a bulk modulus of 50 GPa. The failure strain is chosen as 20%, and the failure stress is chosen as 200 MPa. The projectile is assumed to be rigid, and the mass is chosen as 0.5 kg. The impact velocity is chosen as 3.0 m/s, and the projectile is considered to have gone through the lattice structure. The boundary conditions are taken as clamped-clamped around the four boundary lines.

Figure 10A:
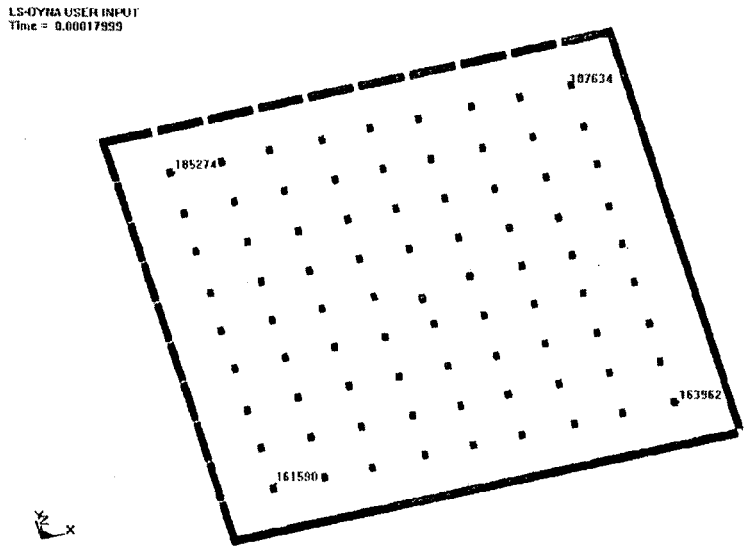
FIG. 10(*a*) is an illustration of the four nodes used to measure the displacement in a lattice structure in accordance with one embodiment of the present invention.
Figure 10B:
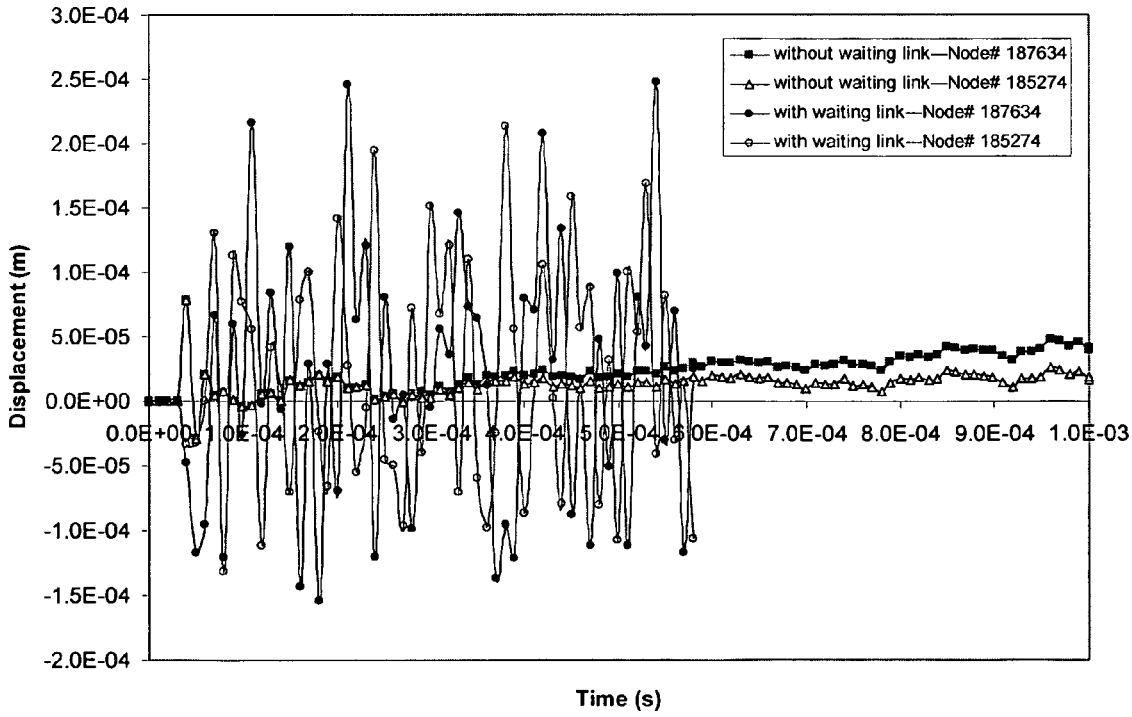
Figure 11A:
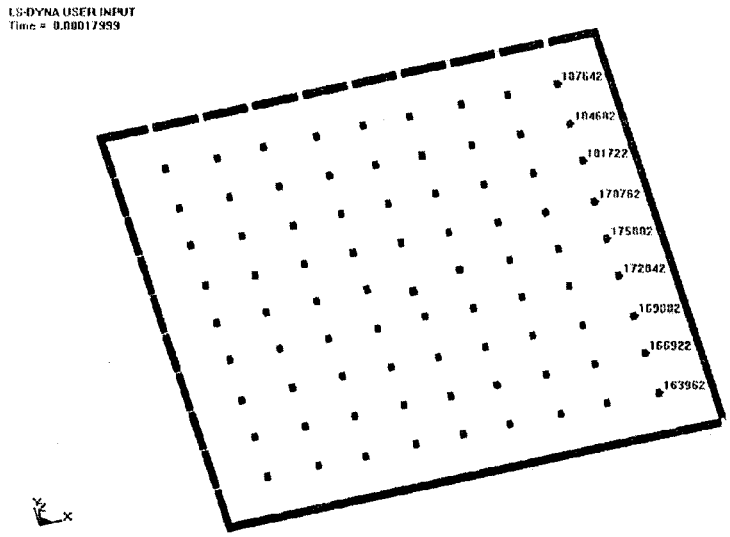
FIG. 11(*a*) is an illustration of the nodes located along a boundary line used to measure the displacement in a lattice structure in accordance with another embodiment of the present invention.
Figure 11B:
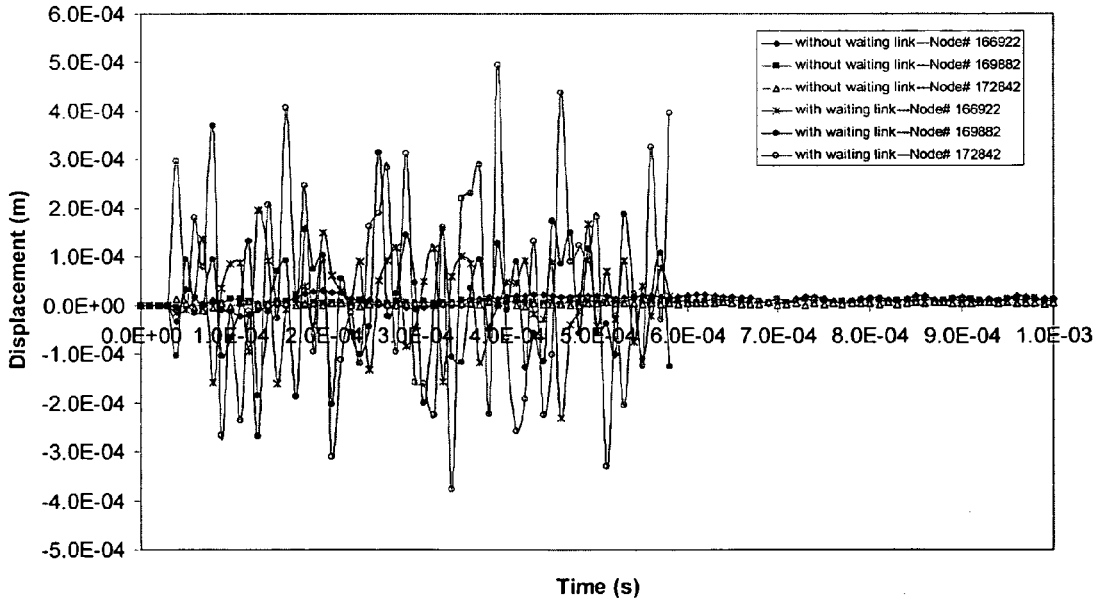

For a lattice structure with a waiting element, the waiting links are also modeled as 8-node solid elements, with a maximal distance 0.2 mm from the main links at the center of each link and tied at the two ends with the main links. The same material parameters are chosen to be the same for the main links. As shown in FIGS. 10 and 11, the displacement-time histories at the two corners and also along the boundary lines are compared, and they indicate that relatively comparative displacements are displayed at different locations of the lattice structure with asymmetric waiting links. Compared to the conventional lattice structure without waiting links, the large vibrations are induced at the corner (see FIG. 10*b*) and along the boundary (see FIG. 11*b*) due to the effect of waiting links, thus avoiding the localized failure. The relatively large displacement of lattice structures with waiting element also indicates the high energy absorption, leading to an improved design.

The numerical model is first calibrated with the semi-analytical model in the above preliminary study and the laboratory quasi-static tests over a 3D lattice structure. Both NATO AP7.62mm round and NATO M80 ball rounds are simulated at muzzle velocity. During the simulation, the distribution of energy, stresses along the links of different lattice structures, distribution of partial damaged links and residual velocity of the projectile is obtained. Once the conformance on the accuracy of numerical simulation is developed, the ballistic impact simulation and analysis of all the proposed lattice designs is carried out.

Effect of Geometry and Loading:

The lattice structures formed in accordance with the present invention with varying geometric parameters under different concentrated impulse loads and blasting loads are studied, using the theoretical and numerical models discussed above. While not wishing to be bound to any one theory, it is believed that the performance of lattice structures within the scope of the present invention depend heavily on geometric parameters (e.g., side length). Additionally, it is believed that different load types (such as, projectile tip shape, the standoff distance, and charge mass, etc.) will also have profound effects over the structures of the present invention. Traditional armor systems are good at blasting loadings. However, with respect to concentrated type impulse loading, conventional armor systems usually have difficulties. Therefore, it is important to simulate a whole system and capture the motions of projectiles.

Modeling of the Projectile:

In modeling, one needs to take into account the penetration of the projectile through the lattice structure and prevent it from slipping through the line of knots. In this regard, the projectile is modeled as an "elastic ball" of the mass $M_p$ centered at the position $Z_p$. The motion of the projectile mass satisfies the following equation:

$$M_p\ddot{Z}_p = \sum_{j=1}^{N(j)} \frac{F_{pj}(|Z_p - Z_j|)}{|Z_p - Z_j|}(Z_p - Z_j) \tag{5}$$

where j is the number of the knot in the structure; $F_{pj}$ is the force function of link between knot p and knot j; $z_p$ and $Z_j$ are the position of projectile and the knot j, respectively; N(j) is the set of knots neighboring the knot j. And the force function is found as:

$$F_{pj}(Z) = \begin{cases} 0 & \text{if } Z > B \\ \ln\left(\dfrac{B-A}{Z-A}\right) & \text{if } A < Z \le B \\ +\infty & \text{if } Z \le A \end{cases} \tag{6}$$

The threshold A and B are constants, which can be set according to different force-approach curves (e.g., atomic force-approach curve).

Modeling of the Blasting Load:

As will be discussed below, the dynamic response to sonic-boom and explosive pressure pulses will be investigated. The sonic-boom overpressure can be expressed as:

$$q_3(t) = \begin{cases} p(1 - t/t_p) & 0 < t < rt_p \\ 0 & t < 0 \text{ and } t > rt_p \end{cases} \tag{7}$$

where p denotes the peak reflected over pressure, $t_p$ denotes the positive phase duration of the pulse measured from the time of impact of the structure, while r denotes the shock pulse length factor. For r=1, the sonic boom wave degenerates into a triangular explosive pulse, while for r=2 and 3, the pulse corresponds to a symmetric and non-symmetric sonic-boom, respectively. And the charged mass and the stand off distance could be related to p and $t_p$.

Effect of Material:

The performance of lattice structures formed in accordance with the present invention (see FIG. 6) depends on material parameters under different concentrated impulse loads or blasting loads. Both the metal and composite materials as well as metal laminate can be used as design materials. The importance of including the plasticity of the bistable links and its effectiveness will be further explored below.

Elastic-Brittle Bistable Link:

Assuming that the material is elastic-brittle, the tensile force T depends on the elongation q as:

$$T(t) = \begin{cases} \mu_b q & \text{if } 0 < q < q^* \text{ and } q(\tau) < q^* \text{ for } \tau < t \\ \mu_w q & \text{if } q^* + G < q < q^{**} \\ 0 & \text{otherwise} \end{cases} \quad (8)$$

where $\mu_b$ is the modulus of the basic link; $\mu_w$ is the modulus of the waiting link.

Figure 12:
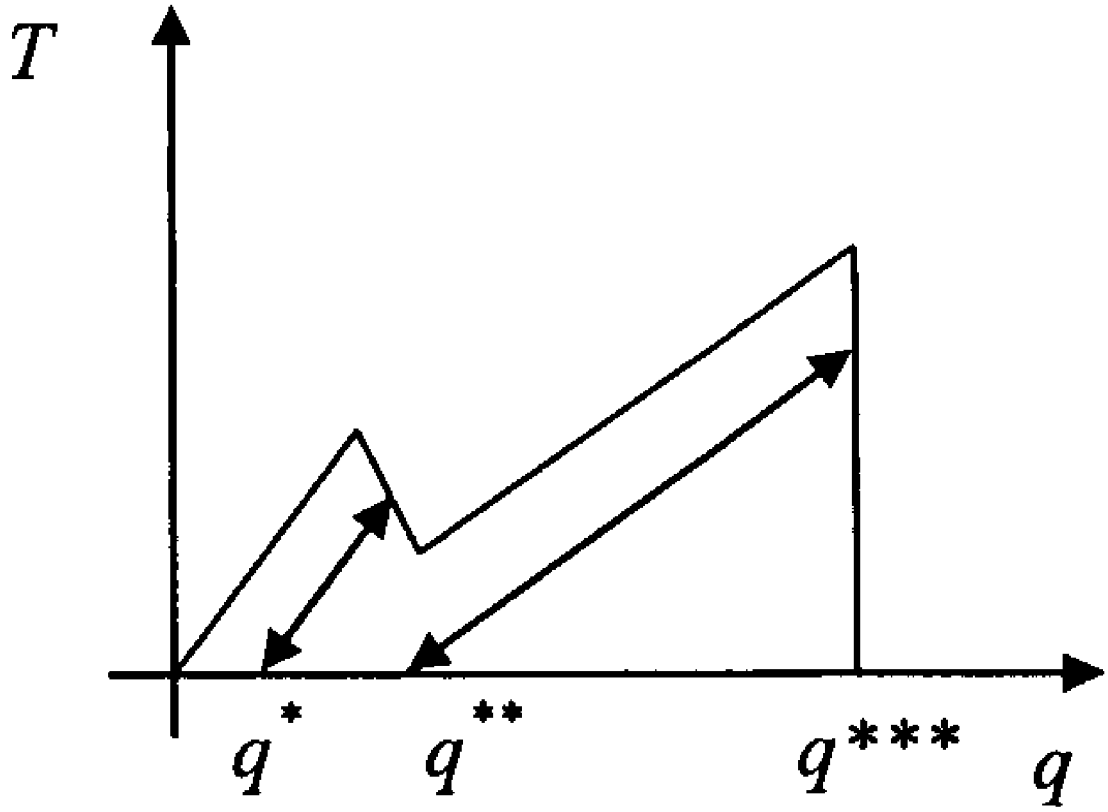
FIG. 12 is a plot of a multi-linear constitutive law for a bistable elastic-plastic waiting link.
Figure 13:
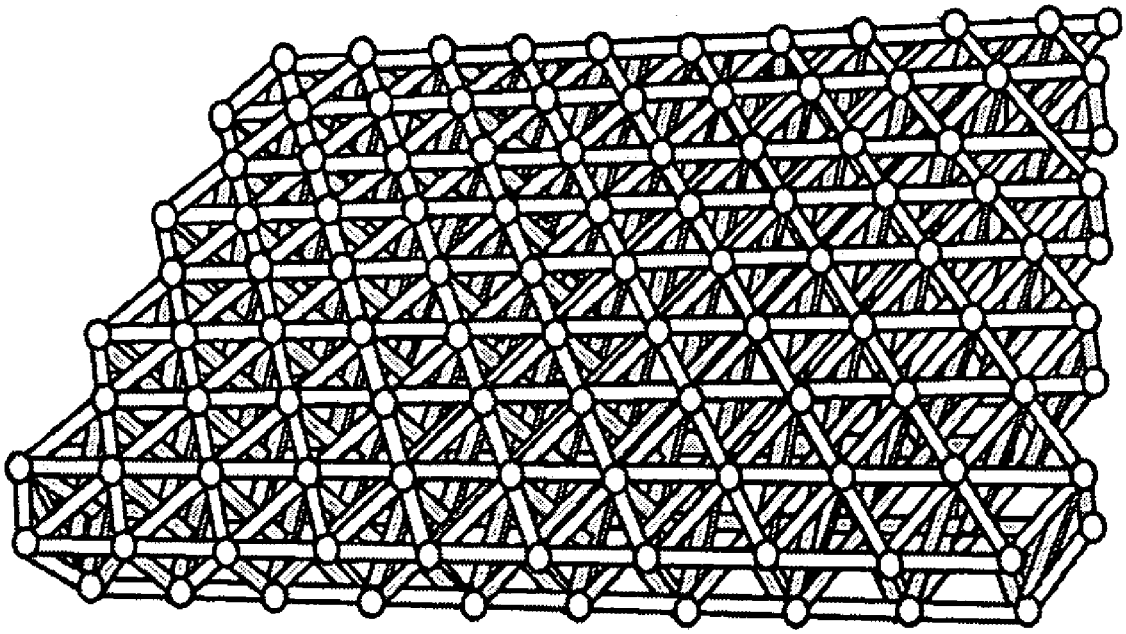
FIG. 13 is an illustration of a 3D analogy of a conventional 2D triangle lattice cell.

Elastic-Plastic Bistable Link:

Assuming that the material is elastic-plastic, the tensile force T depends on the elongation q as:

$$T_b(t) = \begin{cases} \mu_b q & \text{if } 0 < q < q^* \\ q^* - \dfrac{T(q^{**}) - T(q^*)}{q^{**} - q^*}(q - q^*) & \text{if } q^* < q < q^{} \\ q^{} + \dfrac{T(q^{*}) - T(q^{})}{q^{*} - q^{}}(q - q^{}) & \text{if } q^{} < q < q^{*} \\ 0 & \text{if } q > q^{*} \end{cases} \quad (9)$$

and links in a lattice structure experiences the loading and unloading due to the wave passed, the unloading path in an elastic-plastic bistable link takes the shape of corresponding stable branches (see FIG. 12).

The advantages of the lattice structures of the present invention are quantified, under the criteria of the absorbed energy, residual velocities, ballistic limit and design effectiveness, (e.g., the percentage of partial damaged links compared to the total links). Based on the parametric study of the geometric and material effects, the appropriate material and lattice structures are selected, and the expected range of performance of the two lattices and their advantages are summarized. Based on numerical simulations using LS-DYNA, lattice structures that utilize unequal main links and asymmetric waiting links in accordance with the present invention possess several advantages over conventional lattice structures. These advantages include the ability of the lattice structures of the present invention to: (a) more uniformly distributed damage, thereby minimizing banded failure or local deformations; (b) undergo relatively large global deformation, thereby absorbing more energy; and (c) permit/facilitate a failure wave to propagate in a random manner in order to avoid concentration of the localized shear band, thereby improving the effectiveness of an anti-blast design.

The design of blast and impact resistant armor appliqués is a complex task, and it involves a lot of complex phenomena. The journey of finding an effective armor design method has been conducted for decades. Metal plates and polymer matrix composite (PMC) laminates were first used for personal protection for the defeat of small arms projectiles; while backing plates, usually made of ceramics, are employed to against larger projectiles and blast fragments. PMC materials combine the beneficial properties of both the polymer resins (e.g., the ability to absorb and mitigate kinetic energy) and high strength fibers (e.g., their high to ultrahigh elastic modulus and strength). High performance composites possess higher specific strengths (i.e., the ultimate tensile strength divided by the density) than their metal counterparts, and they are capable of providing equivalent ballistic protection at reduced weights. PMC materials which have been utilized in armor applications include fiberglass, aramid, woven composites and polyethylene fiber composites.

Besides PMC materials, the ceramic armors are also used for the containment of blast fragments and bullet penetrators. They were developed strictly for projectile resistance with a high hardness and compressive strength, causing most penetrators to break up upon impact. The need for lighter protection materials for use in military aircraft brought about the use of ceramic armor materials. Ceramics offer an advantage over steel in weight reduction and in ballistic energy absorption. The most common ceramic materials used for armor applications are alumina, boron carbide, silicon carbide and titanium diboride.

A metal lattice or truss structure with or without waiting links could also be used in blast mitigation and armor design. To distribute the partial or localized damage over a large area in as even a manner as possible, lattice structures having waiting links in accordance with the present invention provide a promising solution. They are capable of spreading the localized damage and can be used for blasting mitigation.

There is an immediate demand for effective blast resistant armor appliqués so that the safety and security of military staffs and structures can be significantly improved. The results from the 2D lattice designs of the present invention indicate that the concept of using asymmetric waiting links and unequal main links could greatly reduce the likelihood of banded failure, absorb more energy, and distribute the damage evenly throughout the entire structures.

Furthermore, lattice structures with asymmetric waiting links and unequal main links, formed in accordance with the present invention, have great potential for applications in other areas as well: (1) collision protection and crashworthiness related applications; (2) automobile industries; (3) aerospace industries (e.g., blade-out protection of turbine engine containment); (4) army combat vehicles; (5) protection and retrofit hardening of critical facilities for homeland security; and (6) protection of electronic components and MEMS devices.

Although the invention has been described in detail with particular reference to certain embodiments detailed herein, other embodiments can achieve the same results. Variations and modifications of the present invention will be obvious to those skilled in the art and the present invention is intended to cover in the appended claims all such modifications and equivalents.

What is claimed is:

1. A lattice structure comprising:

a triangle cell lattice structure with one or more asymmetrical waiting elements, wherein the triangle lattice structure is formed from main links having unequal lengths.

2. The lattice structure of claim 1, wherein the triangle lattice structure contains one or more elastic-brittle bistable links.

3. The lattice structure of claim 1, wherein the triangle lattice structure contains one or more elastic-plastic bistable links.

4. The lattice structure of claim 1, wherein the lattice structure is used in an armor applique.

5. The lattice structure of claim 1, wherein the lattice structure is used in a collision protection application.

6. The lattice structure of claim 1, wherein the lattice structure is used in an aerospace application.

7. The lattice structure of claim 1, wherein the lattice structure is used in an electronics impact/shock protection application.

Figure 5A:
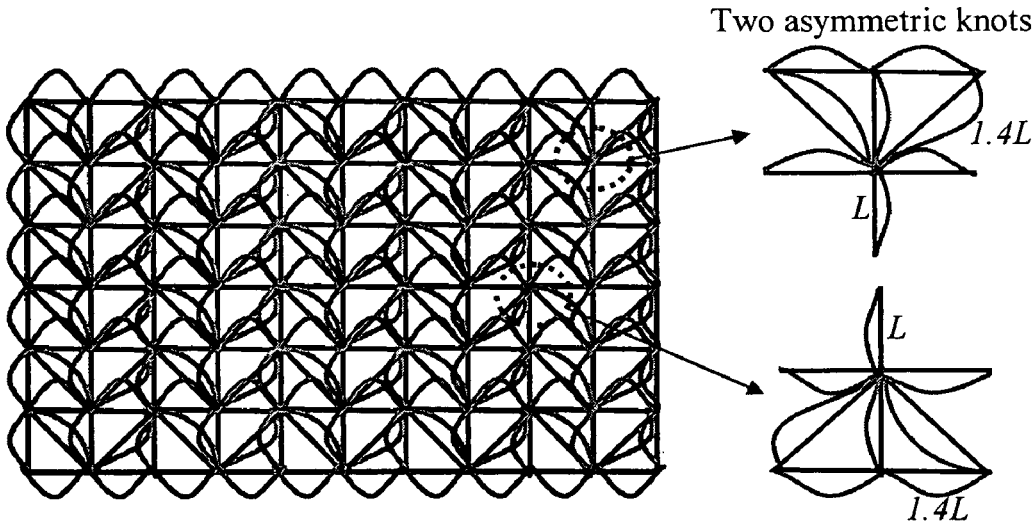
FIG. 5(*a*) illustrates one possible lattice structure within the scope of the present invention the lattice structure being a triangle cell lattice with an asymmetric waiting element.
Figure 5B:
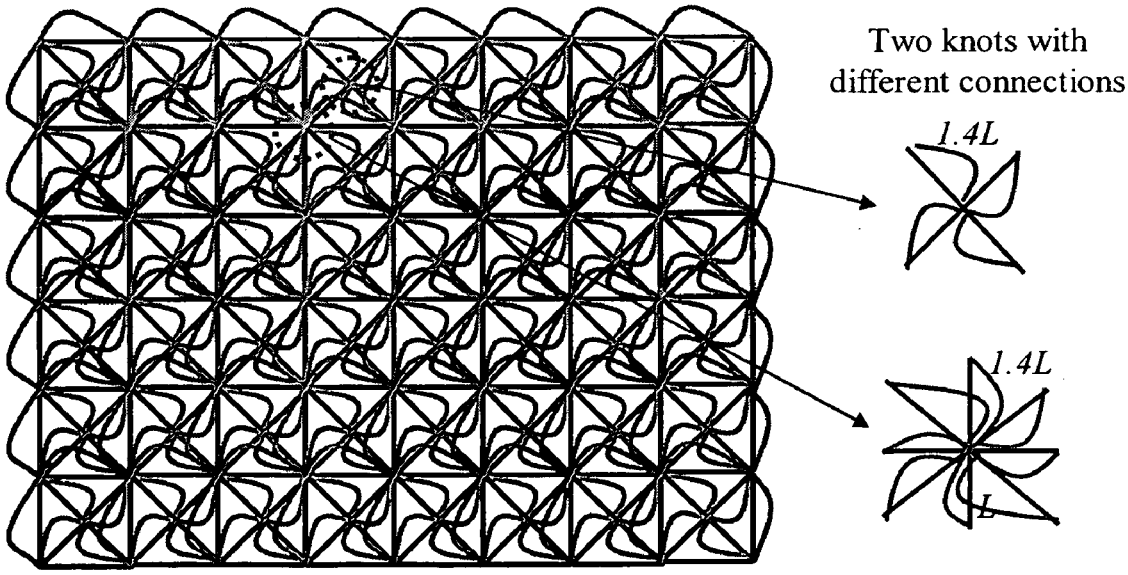

8. A lattice structure comprising: a lattice having a structure as shown in FIG. 5(*a*).

9. A lattice structure comprising: a lattice having a structure as shown in FIG. 5(*b*).

* * * * *